US005794886A

United States Patent [19]

Cook

[11] Patent Number: 5,794,886

[45] Date of Patent: Aug. 18, 1998

[54] ROTATABLY RELEASABLE WIRE REEL CADDY

[76] Inventor: David T. Cook, 2771-25 Monument Rd., Unit 345, Jacksonville, Fla. 32225

[21] Appl. No.: 676,852

[22] Filed: Jul. 8, 1996

[51] Int. Cl.[6] ..... B65H 16/06

[52] U.S. Cl. ..... 242/594.3; 242/598.3; 242/129.6

[58] Field of Search ..... 242/594.3, 594.4, 242/591, 598.3, 598.4, 598.6, 129.6, 129.62

[56] References Cited

U.S. PATENT DOCUMENTS

| | | | |
|---|---|---|---|
| 927,570 | 7/1909 | Maxey | 242/598.4 X |
| 1,871,179 | 8/1932 | Joyce | 242/594.3 |
| 1,891,629 | 12/1932 | Van Wagner | 242/598.4 X |
| 3,050,273 | 8/1962 | Saunders | 242/598.4 X |
| 3,069,110 | 12/1962 | Domer | 242/129.6 |
| 4,385,738 | 5/1983 | McDonald | 242/129.6 |
| 4,548,368 | 10/1985 | Tomlinson | 242/129.6 |
| 5,211,036 | 5/1993 | Engelfried et al. | 242/598.3 X |

FOREIGN PATENT DOCUMENTS

| | | | |
|---|---|---|---|
| 16605 | of 1901 | United Kingdom | 242/129.62 |

*Primary Examiner*—Daniel P. Stodola
*Assistant Examiner*—Gregory J. Strimbu
*Attorney, Agent, or Firm*—Arthur G. Yeager

[57] ABSTRACT

A caddy for supporting a plurality of reels or spools includes a rod movably mounted to a frame. The rod is normally used in a first position for allowing reels mounted thereon to be freely rotatable when wire is dispensed from the reels. Rotation of the frame 90 degrees causes the rod to move to a second position whereby the reels are supported by a member of the frame to allow the rod to be withdrawn laterally without disturbing the reels. An empty reel can be replaced, the rod reinserted and the frame rotated 90 degrees to its original position for dispensing of reel wire by a user. End members of the frame have upstanding ribs on the top and channels on the bottom to provide for vertical stacking of the caddy. Integral handles of the frame allow for carrying of the caddy.

20 Claims, 7 Drawing Sheets

ROTATABLY RELEASABLE WIRE REEL CADDY

BACKGROUND OF THE INVENTION

1. Field of the Invention

The present invention relates to apparatus for carrying rotatable reels or spools for dispensing wire therefrom.

2. Prior Art

There are a wide variety of devices for carrying and supporting spools of various types. None, however, provide for a quick and easy method of removing one empty reel among an array or row of other reels that do not need replacement. Among various spools and spool holders that disclose the above inadequacy are U.S. Pat. Nos. 1,593,781; 1,871,179; 2,342,954; 2,526,440; 2,705,114; 2,841,343; 3,134,555; 3,854,509; 4,172,608; and 4,385,738. None of these devices meet the requirement of easy spool replacement.

SUMMARY OF THE INVENTION

In one aspect of the present invention there is provided a reel holder comprising a frame, including a first and second side wall and a pair of spaced apart end walls connected thereto, an elongate rod having opposite end portions for carrying at least one reel thereon, and support means for movably mounting the rod to the frame at a first and second positions. The first and second side walls are spaced away from the rod a sufficient distance to avoid contact of a portion of each of the sidewall with a reel mounted on the rod when the rod is in the first position. The second side wall has a portion thereof positioned to contact a reel mounted on the rod when the rod is in the second position to provide vertical resting support for a reel independently of the rod.

Other aspects of the present invention include the first side wall being located horizontally while the second side wall is positioned vertically, the rod being freely movable from the first position to the second position when the reel holder is moved to locate the second side wall horizontally and the first side wall vertically. The support means includes a slot formed in each end wall, each slot having a first end portion positioned generally medially in a respective end wall and a second end portion laterally spaced away from the first end portion and generally toward the second side wall. The end portions of the rod are located in corresponding first end portions of both slots when the rod is in the first position and are located in corresponding second end portions of both slots when the rod is in the second position.

The second side wall includes a laterally extending rib member generally along the length thereof between the end walls for engaging a reel when the rod is in the second position. A cover means for at least one end portion of each slot is used to inhibit lateral movement of the rod when the rod is in the first position. The cover means includes a pair of plates attachable to outer surfaces of respective end walls and a pair of pivots for pivotally attaching the plates to the end walls.

The first side wall includes a handle for lifting of the holder. Each end wall includes a top surface including an upstanding rib, the rib being sized to fit within a channel of another holder for vertical stacking thereof. One side wall includes a pair of spaced channels for respectively receiving spaced ribs of the end walls.

Other aspects of the present invention include a reel holder comprising a frame including a first and second side wall and a pair of spaced apart end walls, an elongate rod having opposite end portions for carrying a plurality of separate horizontally disposed reels and having a common rotatable axis, support means for movably mounting the rod between the end walls, the support means including an elongate slot formed in each end wall, each slot being sized to accept therein a respective end portion of the rod to position the rod at either a first or second position. The first and second side walls are spaced away from the slot a sufficient distance to avoid contact with a reel mounted on the rod when the rod is in the first position, the second side wall being positioned to be in contact with a reel mounted on the rod when the rod is mounted in the second position to provide vertical support for a reel independently of the rod. The first side wall is located horizontally while the second side wall is positioned vertically, the rod being freely movable by gravity action from the first position to the second position when the reel holder is moved to position the second side wall horizontally and the first side wall vertically. Each slot has a first end portion positioned generally medially in a respective end wall and a second end portion laterally spaced away from the first end portion and generally toward the second side wall.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE PREFERRED EMBODIMENT

Figure 1:
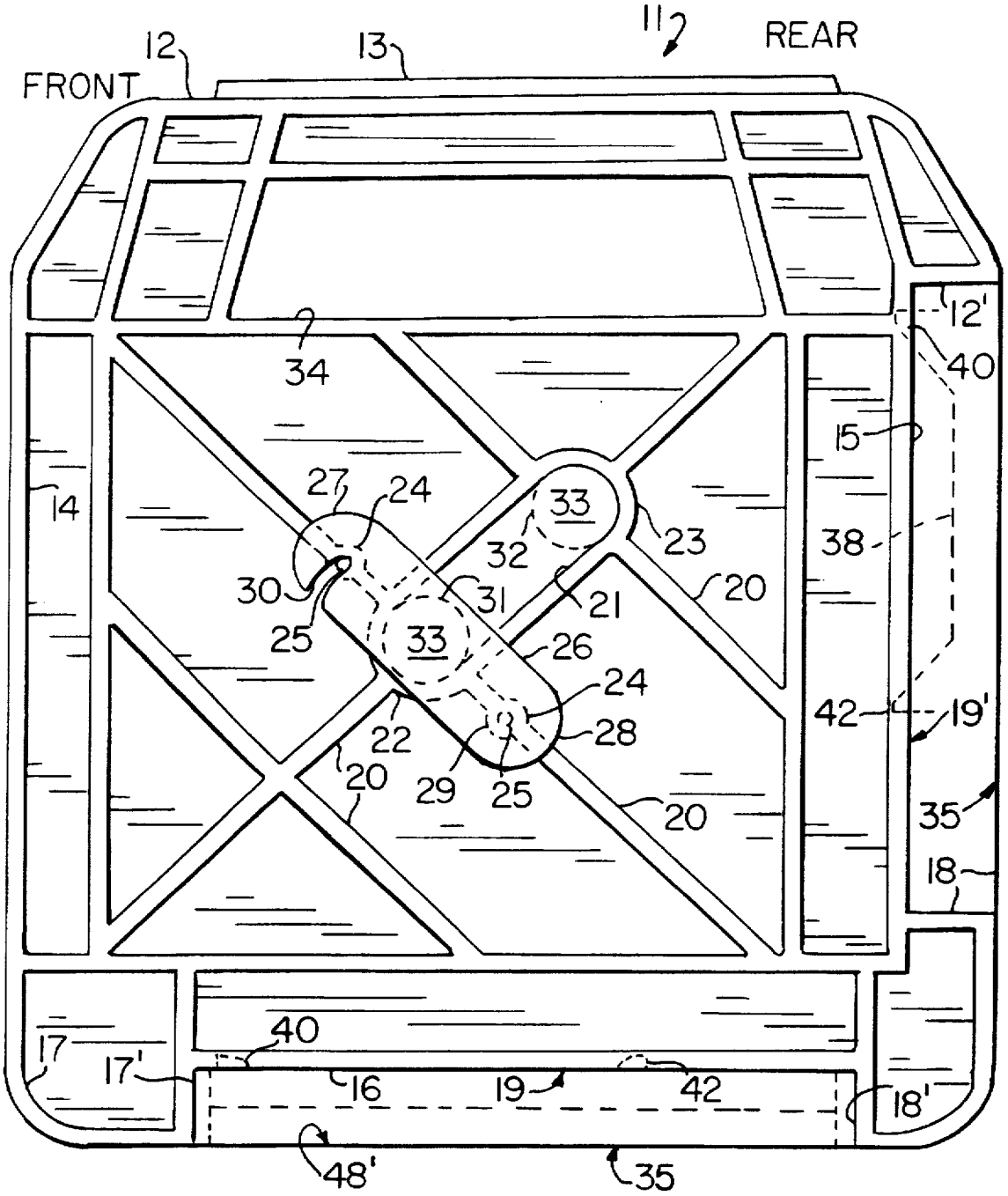
FIG. 1 is a side elevational diagram of one of the end frames of the caddy according to the present invention.

With reference now to the figures, one of two end frames or walls of the wire reel holder or caddy 10 is shown at numeral 11 in FIG. 1. The end frame 11 is preferably a one-piece molded element having a top handle portion 12 with an upstanding rib 13 on top thereof and a front edge portion 14 to provide for stacking of one wire reel caddy 10 on top of another as will be discussed hereinbelow.

Front and rear wall members extend vertically downward to a bottom support member 16 having two leg members 17 and 18 separated by a channel 19 that terminates at respective interior walls 17' and 18'. Cross-wise rib members 20 provide for frame 11 stiffening around an oblong slot 21 which has a forward downwardly disposed end portion 22 and a rearwardly upwardly disposed end portion 23. One rib member 20 includes two screw bosses 24 into which screws (or posts) 25 fit in order to mount retainer plate 26 pivotally around the rearward portion 28 over slot 21 at pivot hole 29. The forward end portion 27 of plate 26 has slot 30 formed therein to engage screw 25. A steel rod 33 used to hold spools of wire can be positioned at position 31 or 32. The rod 33 will normally be in position 31 and secured against lateral motion by plates 26 when the caddy 10 is lifted via handhold passageway 34.

In the preferred embodiment of the present invention there are two end frames 11 which are mirror images of each other and each is preferably molded in a single piece.

The specific construction details of the end frames 11 derive principally from cost and strength/weight considerations, and, as understood in the art, may vary in the circumstances. The caddies 10 are designed to be stackable and to fit tightly together to minimize the storage requirements necessary for field work in various electrical disciplines.

Figure 2:
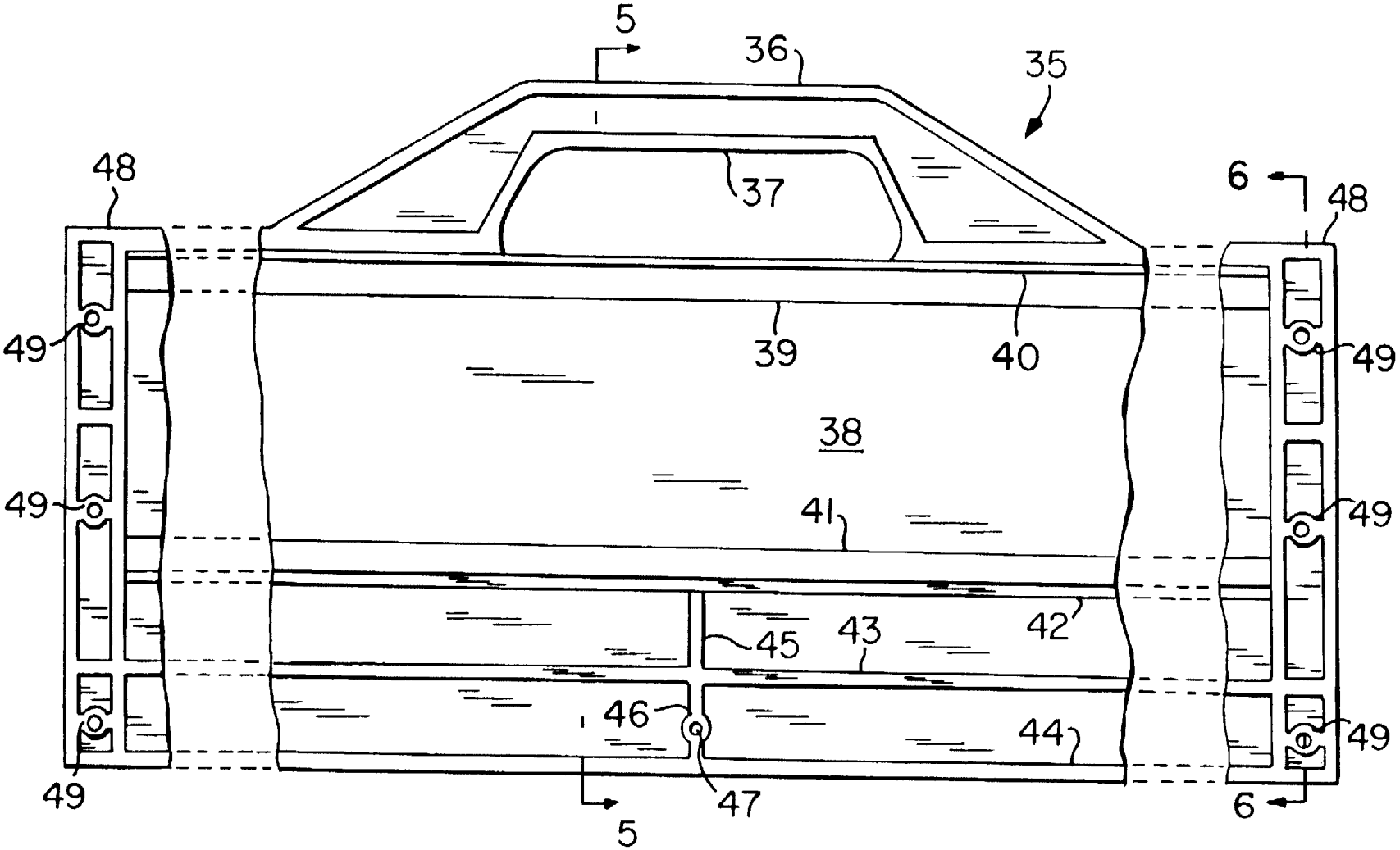
FIG. 2 is a front elevational diagram of one of the side frames of the caddy according to the invention shown in its upright position.

FIG. 2 is a front elevational view of one of two identical side frame members in the form of walls 35. A handle portion 36 with handhold passageway 37 need only be located on one frame 35 as a matter of usage. However, both side frames 35 are one-piece molded elements so as to reduce cost and therefore in practice a caddy 10 will have a handle portion 36 on each frame 35.

Rear wall 38 of frame 35 is vertical and substantially smooth and includes upper cross piece 39 which has a laterally extending rib portion 40 and a lower cross piece 41 has rib portion 42. A further pair of rib members 43, 44 extend the width of frame 35. Vertical cross pieces 45 and 46 provide additional structural rigidity. Lower piece 46 includes a screw boss 47. The specifics of the construction of the frame 35 are the result of the need for sufficient strength and rigidity for the specific application depending upon the desired width of a specific caddy 10.

With reference again to FIG. 1, one frame member 35 fits between the two end frames 11 in channel 19; the other frame 35 fits within channel 19'. Both frames 35 are preferably attached to end frames 11 with at least three screws into respective wall members 15 and 16 or other means as appropriate.

Figure 3:
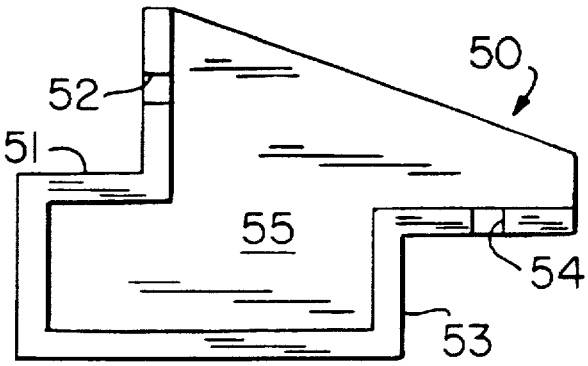
FIG. 3 is a side elevation of the center support bracket of the present invention.
Figure 4:
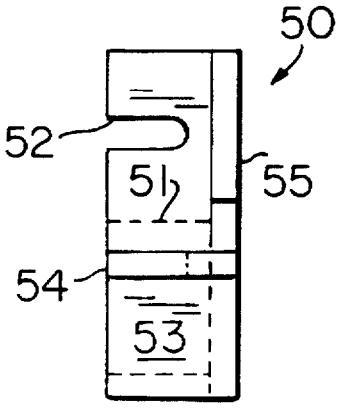
FIG. 4 is a front elevation of the bracket of FIG. 3.

With reference now to FIGS. 3 and 4, two views of a center support bracket 50 are illustrated. The bracket 50 includes a first angled portion 51 with a first screw notch 52 therein and a second angled portion 53 with a second screw notch 54 therein. Additional strength against torsional flexing of the assembled caddy 10 is provided by a side plate member 55. Screw notches 52 and 54 engage screws (or posts) inserted into side frame screw holes 57.

Center bracket 50 provides additional mounting rigidity to the assembled caddy 10 that is necessary if the width of side frames 35 is sufficient to so warrant. It is to be understood that various support devices could be used depending upon the circumstances. When installed, the first angled portion 51 of bracket 50 fits under rib 44 to place first screw notch 52 in line with the vertically disposed frame 35 and screw boss 47. Second screw notch 54 will be thus aligned with the horizontally disposed frame 35 and over respective boss 47 with bracket 50 sized to fit in between both frames 35 and to provide support and rigidity for the caddy 10 when fully assembled.

Figure 5:
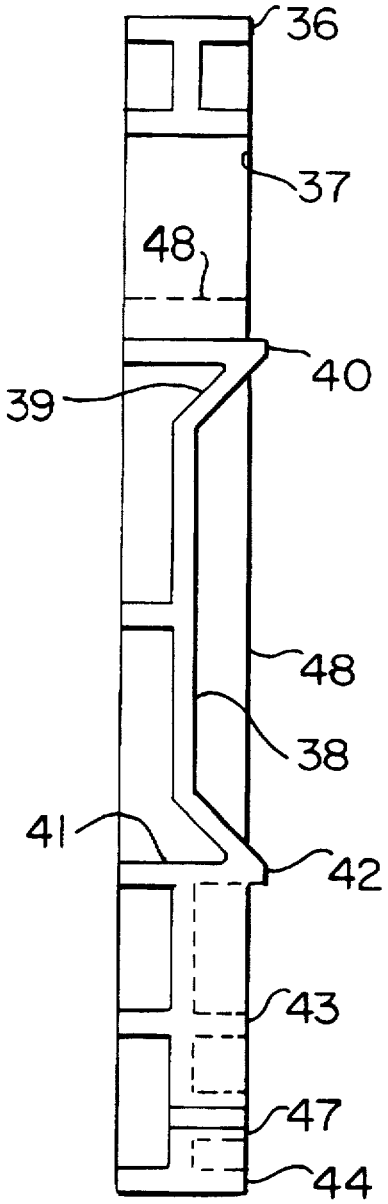
FIG. 5 is a cross sectional view of the side frame of FIG. 2 taken on the line 5—5.
Figure 6:
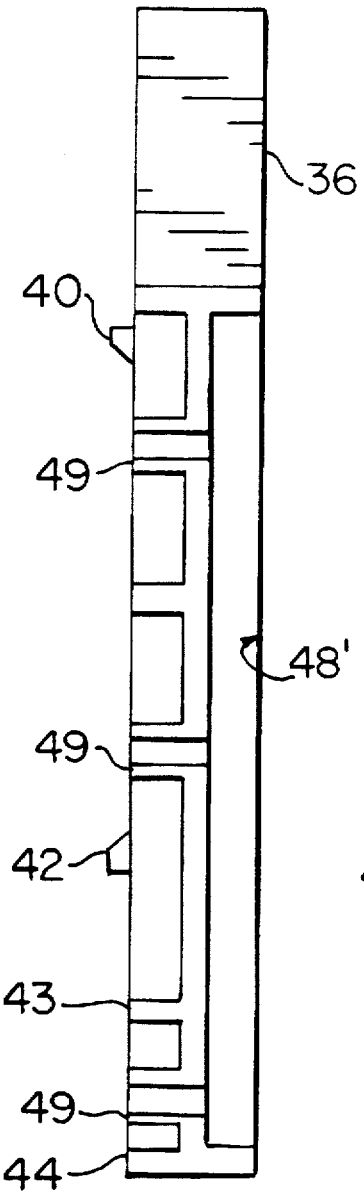
FIG. 6 is a cross section of the side frame of FIG. 2 taken on the line 6—6.
Figure 7:
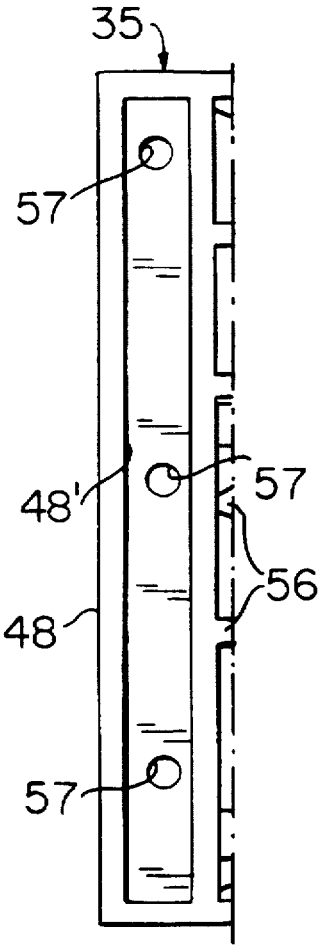
FIG. 7 is a rear view of one end portion of a side frame.

FIGS. 5 and 6 illustrate cross sections of the frame 35 and show the channel 48' formed by walls 48 into which a rib 13 fits when the caddies are stacked. FIG. 7 illustrates the rear portion of a frame 35 showing channel 48', stiffening ribs 56 and screw holes 57.

Figure 8:
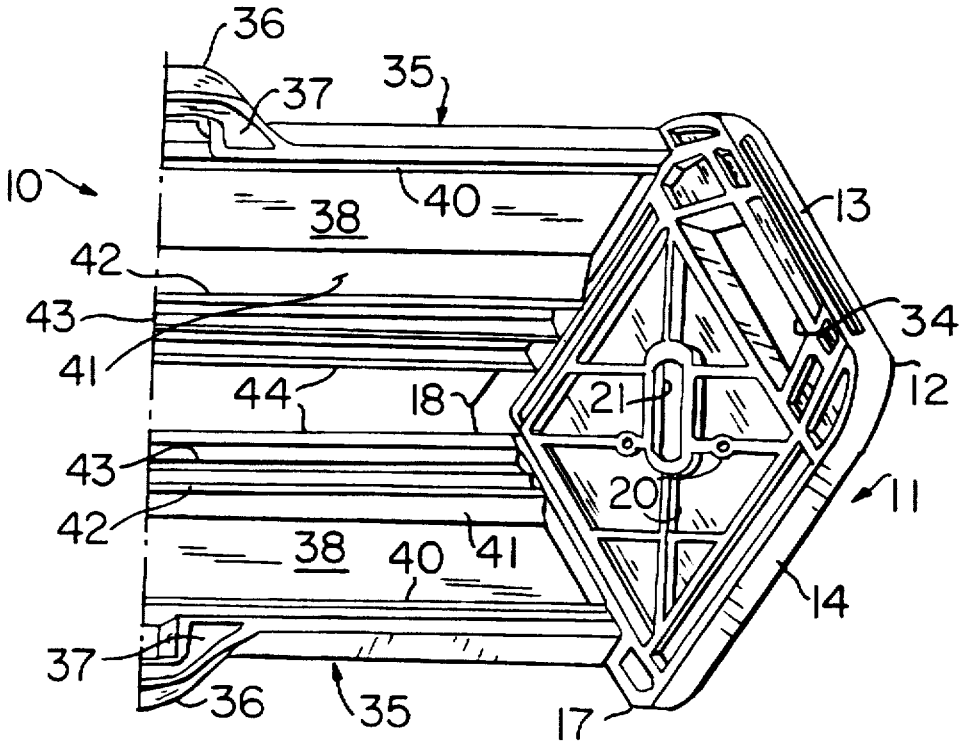
FIG. 8 is a partial perspective view of the assembled caddy in accord with the present invention.

In use the caddy 10 will be positioned upright as illustrated in the partial perspective of FIG. 8 with both frames 35 assembled together by screws (not shown) through holes 49 and 57 as understood in the art. Steel rod 33 is positioned as shown at 31 in FIG. 1 providing clearance for the wire reels mounted thereon. When a reel is empty, the caddy 10 is rotated to place rear members 12' and 18 horizontally on a floor surface with bottom 16 now vertical. This action results in rod 33 moving via gravity action toward position 32 in oblong slot 21. Wire reels on the rod 33 will then rest against rib 40 of frames 35. At this time rod 33 can be withdrawn with a horizontal motion because the wire reels are completely supported on frames 35. The empty reel can be removed forwardly or upwardly and replaced. Rod 33 is then replaced as shown at position 32. Caddy 10 is then rotated forwardly to place rod 33 in position 31. Preferably, the retainer plates 26 on each end are secured into place to prevent lateral movement of rod 33. One or both plates 26 may be permanently affixed in the position shown or one slot 21 may be completely and permanently covered because only one slot 21 need be accessible for the insertion of the rod 33 during initial assembly. As mentioned before hereinabove, the specific fabrication details are largely irrelevant to a specific caddy 10. What is important however, is the movement of rod 33 to position 31 during normal use of the caddy 10 and the movement of rod 33 to position 32 to cause the wire reels to rest against rib 40. During normal usage the inner surface of wall 38 is recessed away from the ribs 40 and 42 to allow for rotation of a wire reel.

As mentioned hereinabove, the rib 13 on top of end frames 11 is designed to provide for stability of a plurality of caddies 10 that are stacked vertically one on top of another by positioning channel 48' over rib 12 (FIGS. 6–7). The specific construction materials and structural aspects of the caddy 10, such as the use of rib members 20, are selected with stacking and other uses in mind.

Figure 9:
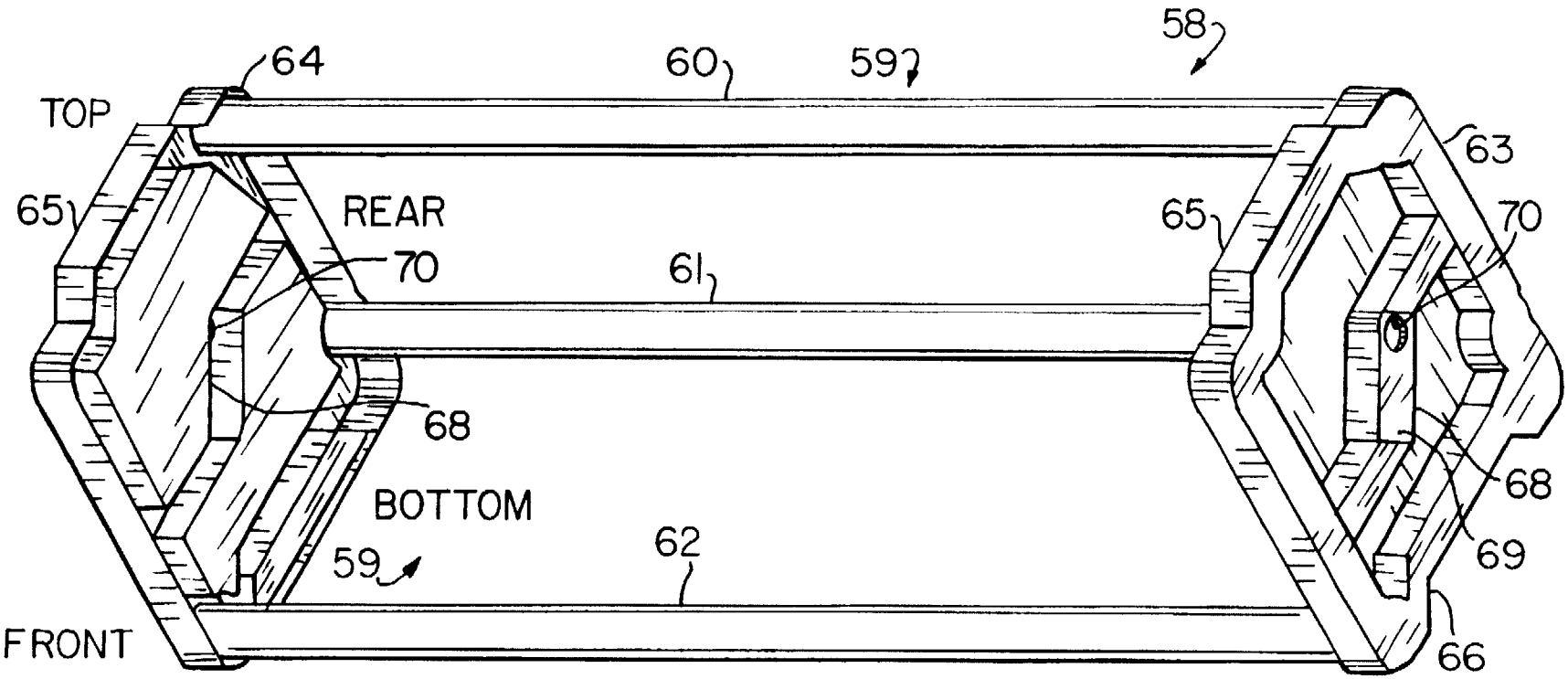
FIG. 9 is a front perspective of an alternative embodiment of the caddy according to the present invention.
Figure 10:
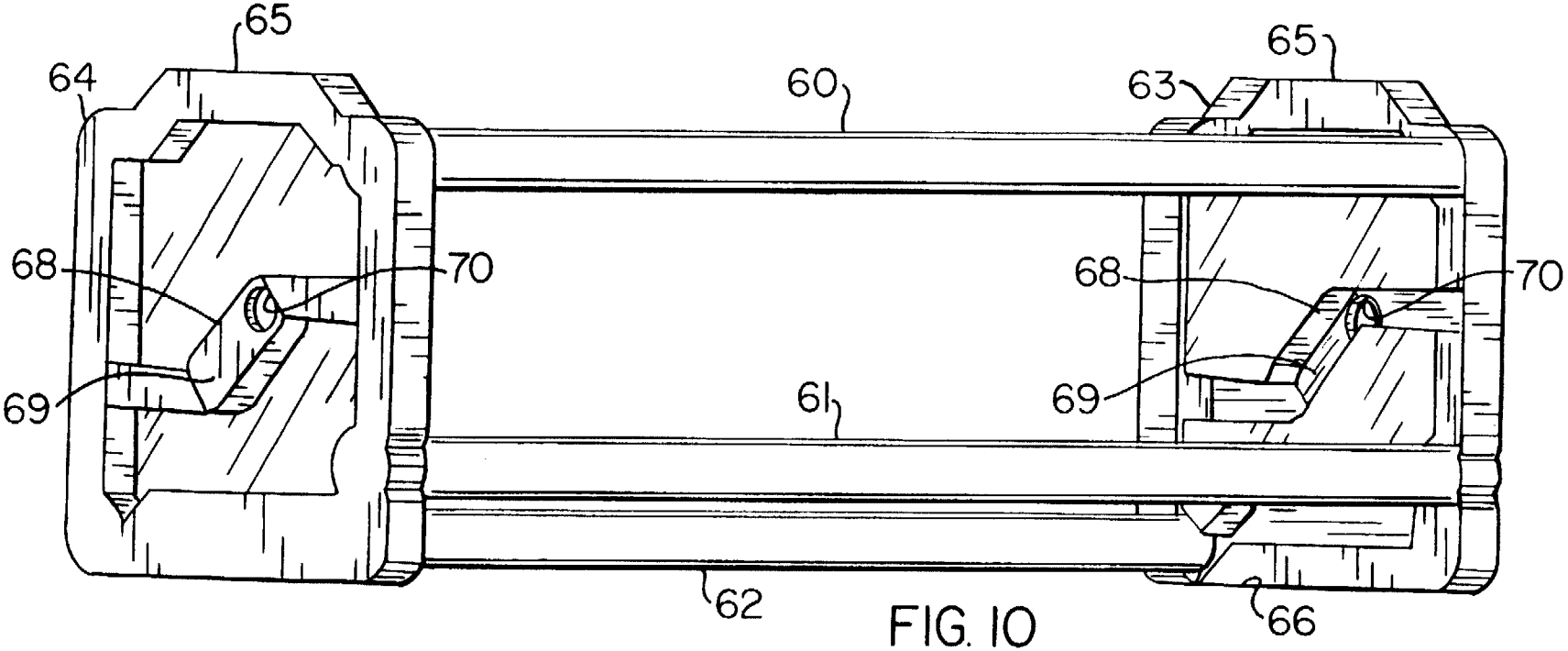
FIG. 10 is a rear perspective of the caddy of FIG. 9.
Figure 11:
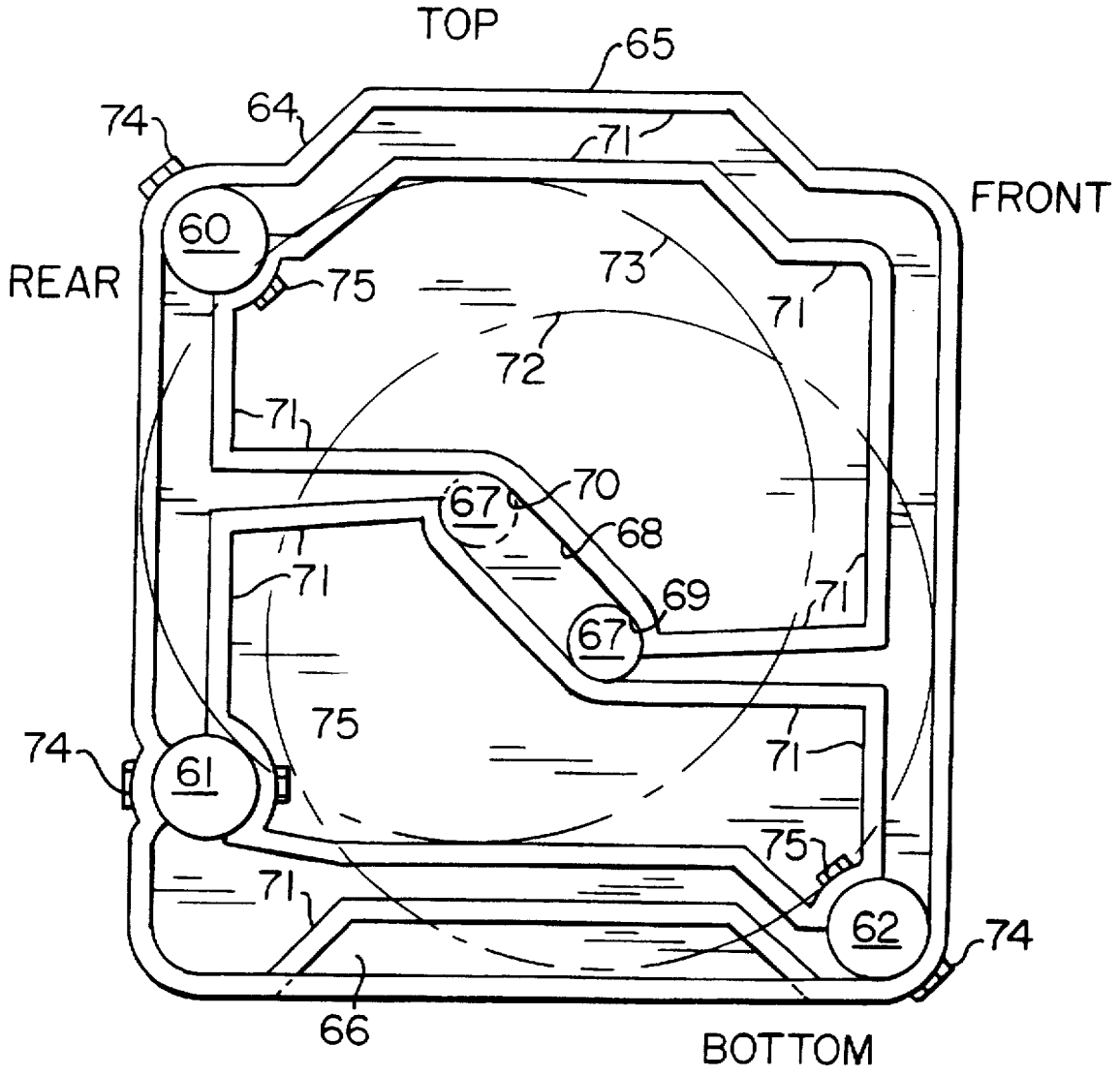
FIG. 11 is a line drawing of an end frame member of the caddy of FIG. 9 illustrating the positions of the rod and associated wire reel positions.

The above description is of the preferred embodiment of the wire reel caddy in accord with the present invention. An alternative embodiment is illustrated in FIGS. 9–11 at numeral 58. In this embodiment, the two side frame members 59 each include two of three metal rods or bars 60, 61 and 62 which are bolted to end frames or walls 63 and 64. The end frames 63 and 64 are vacuum-formed plastic pieces that include an upraised shoulder 65 for stacking the holder 58 vertically using a corresponding channel 66 that is also formed in the bottom of each end frame 63, 64.

One side frame member 59 consists of the arrangement of rods 60 and 61 spaced to provide sufficient strength for the caddy 58 but also positioned to make contact with a wire reel when the caddy 58 is rotated as will be described. A second side frame member 59 is comprised of the two rods 61, 62 that are spaced to provide support for the caddy 58 and to provide for non-engagement of a wire reel in normal operation of the caddy 58. Rod 67 is rotatable mounted in rod channel 68 that is formed to have a first end portion 69 for normal use of the wire reels mounted on rod 67 and a second end portion 70 for mounting the rod 67 when the caddy 58 is rotated rearwardly in order to remove the rod 67 and allow for replacement of a wire reel. The line drawing of FIG. 11 illustrates reel perimeters 72 and 73 that correspond to first and second position 69, 70 respectively, of rod 67.

Ribs 71 derive from the vacuum-forming process and are designed to provide sufficient rigidity of the end frames 63 and 64. Bolts 74 and nuts 75 are used to secure the rods 60, 61 and 62 to the end frames 63 and 64. As understood in the art, other means for connecting the rods 60–62 to frames 63 and 64 can be used if so desired.

As clearly shown in FIGS. 9–10, only the second end portion 70 of the slot 68 is open to provide for removal of the rod 67. This eliminates the need for the retainer plate 26 that is used on the preferred embodiment of the caddy discussed hereinabove.

It is to be noted that the specific fabrication of the end frames 63 and 64, including the channel 68, will define the exact shape thereof and the need, number, and pattern of ribs 71. As with the preferred embodiment, the end frames 63 and 64 are preferably mirror images and are designed to minimize cost and weight. Rods 60–62 may be hollow pipe or solid rod depending upon the projected weight of the wire reels to be carried and the size of the caddy 58.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A reel holder comprising an elongated frame, said frame including first and second side frame members and a pair of spaced apart end walls respectively connected to said frame members, an elongate rod having opposite end portions each disposed in a respective one of said end walls, said elongate rod carrying at least one reel thereon, and support means for movably mounting said rod to said frame at first and second positions, said rod being movable in a direction perpendicular to a longitudinal axis of said frame between said first and second positions, said first and second side frame members being spaced away from said rod a sufficient distance to avoid contact of a portion of each of said side frame members with said at least one reel carried on said rod when said rod is in said first position, said second side frame member having a portion thereof in contact with said at least one reel carried on said rod when said rod is in said second position without removal of said rod from either of said end walls to provide vertical resting support for said at least one reel independently of said rod, said rod being uniformly movable toward and away from both said side frame members, each said end wall having a first and second surface for selectively engaging a horizontal surface with said rod being in said first position when each said end wall first surface is engaged with the horizontal surface and a in said second position when each said end wall second surface is engaged with the horizontal surface.

2. The reel holder as defined in claim 1 wherein said first side frame member includes first and second bar members, said second side frame member including said second bar member and a third bar member, said first side frame member positioned horizontally and said second side frame member positioned vertically to position said rod in said first position, said rod being freely movable from said first position to said second position when said reel holder is moved to locate said second side frame member horizontally and said first side frame member vertically.

3. The reel holder as defined in claim 1 wherein said support means includes a channel formed in each said end wall, each said channel having a first end portion positioned generally medially in a respective said end wall and a second end portion laterally spaced away from said first end portion and generally toward said second side frame member.

4. The reel holder as defined in claim 3 wherein said end portions of said rod are each located in a respective said first end portion of said channels when said rod is in said first position and said end portions of said rod are each located in a respective said second end portion of said channels when said rod is in said second position.

5. The reel holder as defined in claim 3 further including a cover means for at least said second end portion of each said chanel to inhibit lateral movement of said rod when said rod is in said second position.

6. The reel holder as defined in claim 5 wherein said cover means includes a pair of plates each attachable to an outer surface of a respective said end wall.

7. The reel holder as defined in claim 6 wherein said cover means includes a pair of pivots, each said pivot for pivotally attaching one of said plates to said respective end wall.

8. The reel holder as defined in claim 1 wherein said portion of said second side frame member includes a pair of spaced bar members.

9. The reel holder as defined in claim 1 wherein said first side frame member includes a handle for lifting of said holder.

10. The reel holder as defined in claim 1 wherein each said end wall includes a top surface and a bottom surface, each said top surface including an upstanding rib, each said bottom surface including a channel, each said rib adapted to fit within a corresponding channel of a vertically adjacent reel holder for vertical stacking thereof on said reel holder.

11. The reel holder as defined in claim 10 wherein at least one of said first and second side frame members is formed as an elongate member, said elongate wall member including a pair of spaced channels adapted to respectively receive spaced ribs of end walls of an adjacent reel.

12. A reel holder comprising an elongated frame, said frame including first and second side walls and a pair of spaced apart end walls respectively connected to said side walls, an elongate rod having opposite end portions and carrying a plurality of separate horizontally disposed reels, the reels having a common axis about which the reels rotate, support means for movably mounting said rod between said end walls, said support means including an elongate slot formed in each one of said end walls, each said slot being sized to accept therein a respective said end portion of said rod to position said rod at one of a first and a second position, said first and second side walls being spaced away from said slots a sufficient distance to avoid contact with the reels carried on said rod when said rod is in said first position, said second side wall being in contact with the reels carried on said rod when said rod is located in said second position to provide vertical support for the reels independently of said rod, said rod being movable in a direction perpendicular to a longitudinal axis of said frame between said first and second positions each said end wall having a first and second surface for selectively engaging a horizontal surface with said rod being in said first position when each said end wall first surface is engaged with the horizontal surface and in said second position when each said end wall second surface is engaged with the horizontal surface.

13. The reel holder as defined in claim 12 wherein when said first side wall is located horizontally and said second side wall is positioned vertically said rod is in said first position, said rod being freely movable from said first position to said second position when said reel holder is moved to position said second side wall horizontally and said first side wall vertically.

14. The reel holder as defined in claim 12 wherein each said slot has a first end portion positioned generally medially in a respective said end wall and a second end portion laterally spaced away from said first end portion and generally toward said second side wall.

15. The reel holder as defined in claim 14 wherein said end portions of said rod are each located in a respective said first end portion of said slots when said rod is in said first position and said end portions of said rod are each located in a respective said second end portion of said slots when said rod is in said second position.

16. The reel holder as defined in claim 12 wherein said second side wall includes a laterally extending rib member generally along the length thereof between said end walls for engaging the reels when said rod is in said second position to place the reels on said rib to allow for removal of said rod from the reels.

17. The reel holder as defined in claim 12 further including a cover means for at least an end portion of each said slot to inhibit lateral movement of said rod.

18. The reel holder as defined in claim 12 further including a means defined by a pair of plates each attachable to an outer surface of a respective said end wall to inhibit lateral movement of said rod.

19. The reel holder as defined in claim 12 further including a handle attached to said frame for vertical lifting of said holder.

20. The reel holder as defined in claim 12 wherein each said end wall includes a top surface and a bottom surface, each said bottom surface including a channel, each said top surface including an upstanding rib, each said channel being adapted to receive a rib of a vertically adjacent reel holder for vertically stacking thereof on said reel holder.

* * * * *